US006753478B2

(12) United States Patent
Rodway et al.

(10) Patent No.: US 6,753,478 B2
(45) Date of Patent: Jun. 22, 2004

(54) ELECTRICAL WIRE INSULATION

(75) Inventors: Giles Henry Rodway, Calne (GB); Joseph Charles Read, Swindon (GB); Liam McKeough, Swindon (GB)

(73) Assignee: Tyco Electronics UK Limited, Swindon (GB)

( * ) Notice: Subject to any disclaimer, the term of this patent is extended or adjusted under 35 U.S.C. 154(b) by 0 days.

(21) Appl. No.: 10/239,687

(22) PCT Filed: Mar. 16, 2001

(86) PCT No.: PCT/GB01/01143

§ 371 (c)(1),
(2), (4) Date: Sep. 13, 2002

(87) PCT Pub. No.: WO01/69610

PCT Pub. Date: Sep. 20, 2001

(65) Prior Publication Data

US 2003/0051900 A1 Mar. 20, 2003

(30) Foreign Application Priority Data

Mar. 16, 2000 (GB) ..... 0006333

(51) Int. Cl.[7] ..... H01B 7/02
(52) U.S. Cl. ..... 174/120 R
(58) Field of Search ..... 174/120 R, 120 SR, 174/110 PM, 110 V, 110 FC

(56) References Cited

U.S. PATENT DOCUMENTS 3,269,862 A 8/1966 Lanza et al. ..... 117/218
3,632,441 A 1/1972 Bilow ..... 117/218

(List continued on next page.)

FOREIGN PATENT DOCUMENTS

EP 0 089 266 9/1983 ..... H01B/11/18
EP 0 528 611 2/1993 ..... H01B/11/06

(List continued on next page.)

OTHER PUBLICATIONS

British Search Report for British Application No. GB 0006333.9, dated Jul. 26, 2000.
British Search Report for British Application No. GB 9820214.6, dated Feb. 2, 1999.

(List continued on next page.)

*Primary Examiner*—Chau N. Nguyen

(57) ABSTRACT

An electrical wire or cable having insulation comprising a first layer of a polyolefin-based formulation, of which at least 20%, preferably at least 40%, more preferably at least 60% or very preferably at least 80% of the weight of the polymeric portion of the formulation consists of a carbonyl-containing polymer (homopolymer or copolymer or terpolymer), the at least one constituent monomer of the polymer being a carboxylic acid ester, preferably an acrylate or acetate, especially an alkyl acrylate (preferably methyl acrylate, ethyl acrylate, propyl acrylate or butyl acrylate), the monomer itself being at least 5%, preferably at least 9%, more preferably at least 15% by weight of the said co- or terpolymer when used, and the remainder or the majority of the remainder of the said co- or terpolymer preferably being derived from olefinic monomer, preferably ethylene;

a second layer of another material formulation in contact with the first layer, containing at least 10%, more preferably at least 50%, very preferably at least 90%, especially 100%, by weight of the second layer, of non-PVDF-based fluoropolymer, preferably based on ETFE or ECTFE;

wherein the first and second layers are cross-linked while in contact with each other, preferably by radiation, more preferably ionising radiation, sufficient to create a significant bond between the two layers, or to increase the peel bond strength between the layers to at least 3N, preferably increasing the bond strength by at least 50%, more preferably by at least 100%, especially by at least 500% or 1000%, compared to that between the layers prior to being cross-linked.

21 Claims, 1 Drawing Sheet

U.S. PATENT DOCUMENTS

| | | | | |
|---|---|---|---|---|
| 3,650,827 | A | 3/1972 | Brown et al. | 117/218 |
| 3,864,228 | A | 2/1975 | Rosetti, Jr. | 204/159.2 |
| 4,454,249 | A | 6/1984 | Suzuki et al. | 521/54 |
| 4,575,533 | A | 3/1986 | Horie et al. | 525/72 |
| 4,606,595 | A | 8/1986 | Dola | 339/99 R |
| 4,621,107 | A | 11/1986 | Lagow et al. | 522/131 |
| 4,693,940 | A | 9/1987 | Vogdes et al. | 428/422 |
| 5,589,028 | A | 12/1996 | Robinson et al. | 156/306.6 |
| 5,958,532 | A | 9/1999 | Krause et al. | 428/36.3 |
| 6,074,719 | A | 6/2000 | Fukushi et al. | 428/36.9 |
| 6,096,428 | A | 8/2000 | Jing et al. | 428/421 |
| 6,251,506 | B1 | 6/2001 | Davis et al. | 428/213 |

FOREIGN PATENT DOCUMENTS

| | | | |
|---|---|---|---|
| GB | 1117118 | 10/1965 | H01B/3/44 |
| WO | WO 89/00759 | 1/1989 | H01B/7/02 |
| WO | WO 97/27260 | 7/1997 | C09J/127/16 |
| WO | WO 00/17889 | 3/2000 | H01B/3/44 |

OTHER PUBLICATIONS

International Search Report for International Application No. PCT/GB99/03116 dated Jan. 18, 2000.

International Search Report for International Application No. PCT/GB01/01143, filed Jun. 1, 2001.

WPI Abstract Accession No. 92–296862 & JP4206404 (Jul. 28, 1992), abstract only.

WPI Abstract Accession No. 93–002962 & JP4329212 (Nov. 18, 1992), abstract only.

WPI Abstract Accession No. 93–002963 & JP4329213 (Nov. 18, 1992), abstract only.

WPI Abstract Accession No. 94–054027 & JP6009844 (Jan. 18, 1994), abstract only.

FIGURE
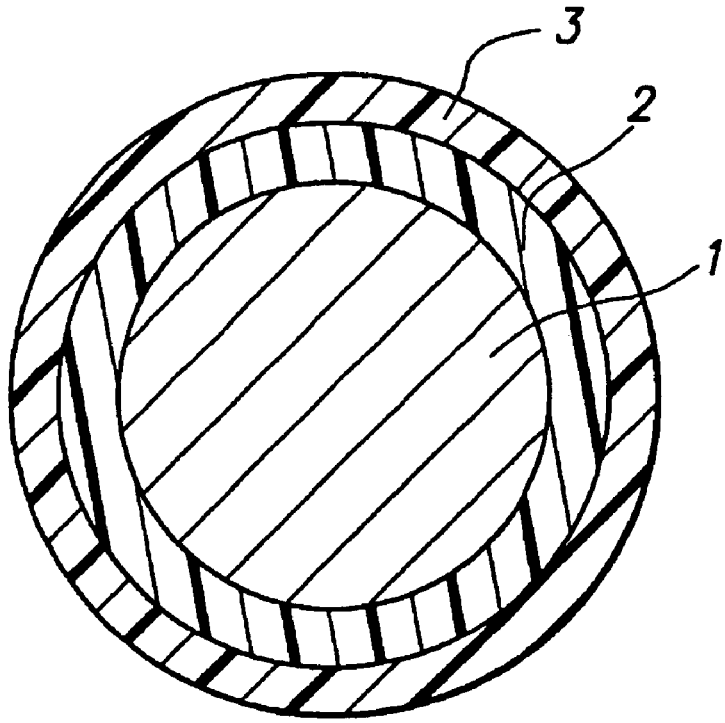

ELECTRICAL WIRE INSULATION

BACKGROUND OF THE INVENTION

This invention relates to insulation for electrical wire or cable.

Wire and cable with chemically-resistant dual-wall insulation comprising a polyolefin inner layer and a fluoropolymer outer layer have been commercially available for over 30 years. Such insulation suffers, from a number of performance shortcomings, including a tendency to wrinkling, crack propagation, and peeling of the outer insulation layer.

SUMMARY OF THE INVENTION

It has now been surprisingly discovered, according to the present invention, that improved insulation can be provided by a first layer comprising a selected carbonyl-containing polymer and an adjacent second layer comprising a selected fluoropolymer. These layers can be bonded together by cross-linking to provide insulation having improved performance characteristics in one or more areas such as resistance to abrasion, peeling (especially if one of layers is damaged), blistering (especially if beat is applied), delamination, creasing and wrinkling (especially when the insulation is subject to mechanical stress or exposure to solvents).

Throughout this specification, including the claims, the terms "a", "an" and "the" before an item mean that there can be a single such item or two or more such items, unless the context makes this impossible (for example, in the first aspect of the invention, the first polymeric componene can comprise a single carbonyl-containing polymer as defined or two or more such polymers; and the second polymeric component can contain a single fluoropolymer or a mixture of two or more fluropolymers); and the term "consisting essentially of" certain ingredients means that those ingredients are necessarily present and that other ingredients may be present providing that they do not have an adverse effect on the desired properties of the insulation.

In a first aspect, this invention provides an electrical wire or cable having insulation comprising:

(I) a first layer which is composed of a first polymeric composition consisting of a first polymeric component and optionally a first non-polymeric component, the first polymeric component comprising at least 20%, preferably at least 40%, more preferably at least 60% or at least 80%, by weight, based on the weight of the first polymeric component, (or, in some embodiments, based on the weight of the whole composition) of a carbonyl-containing polymer (which may be a homopolymer or copolymer, including terpolymer, and which preferably has a non-aromatic backbone), the carbonyl-containing polymer comprising repeating units derived from a monomer which (i) can be copolymerized with an olefinic monomer and (ii) contains a carboxylic acid ester group, preferably an acrylate or acetate, especially an alkyl acrylate (preferably methyl acrylate, ethyl acrylate, propyl acrylate or butyl acrylate), the units derived from said monomer constituting at least 5%, preferably at least 9%, more preferably at least 15%, for example 15 to 28%, by weight of the carbonyl-containing polymer, and any other repeating units of the carbonyl-containing polymer preferably being derived from an olefinic monomer, preferably ethylene;

(II) a second layer which is in direct contact with the first layer at an interface, and which is composed of a second polymeric composition consisting of a second polymeric component and optionally a second non-polymeric component, the second polymeric component comprising at least 10%, preferably at least 50%, particularly at least 90%, for example substantially 100%, by weight based on the weight of the second composition, of a fluoropolymer, and being free of polymers containing more than 50% by weight, based on the weight of the polymer, of repeating units derived from vinylidene fluoride.

Preferably, the layers (I) and (II), while in contact with each other, have been subjected to conditions which cause cross-linking of polymers at the interface between them, preferably by subjecting the layers to radiation, particularly ionising radiation. The cross-linking is preferably such that at least one of the following conditions is fulfilled (i) the peel bond strength between the layers, measured by ASTM 81876-95, is at least 3N, preferably more than 5N, e.g. more than 10N (ii) when a sample of the electrical wire or cable is subjected to steps (a), (b) and (c), there is no delamination of the two layers, step (a) being to slit the insulation axially over a length of 50 mm down to the conductor, step (b) being to wrap the wire around a mandrel whose diameter is twice the diameter of the insulated wire, with the slit on the outside of the wrapped wire, thus exposing the conductor, and step (c) being to unwrap the wire from the mandrel until the wire is straight, and (iii) the peel bond strength after the crosslinking, measured by ASTM B1876-95, is at least 50% greater, preferably at least 100% greater especially at least 500% or 1000% greater, than the peel bond strength before the crosslinking, measured by ASTM B1876-95.

Throughout this specification, including the claims, the terms "a", "an" and "the" before an item mean that there can be a single such item or two or more such items, unless the context makes this impossible (for example, in the first aspect of the invention, the first polymeric component can comprise a single carbonyl-containing polymer as defined or two or more such polymers; and the second polymeric component can contain a single fluoropolymer or a mixture of two or more fluoropolymers); and the term "consisting essentially of" certain ingredients means that those ingredients are necessarily present and that other ingredients may be present providing that they do not have an adverse effect on the desired properties of the insulation.

A second aspect of the invention provides a method of making an insulated wire or cable, the method comprising the steps of (A) providing an electrical conductor surrounded by
  (i) a first layer which is composed of a first polymeric composition as defined in the first aspect of the invention; and
  (ii) a second layer which is composed of a second polymeric composition as defined in the first aspect of the invention;
  the first and second layers being in direct contact with each other at an interface; and (B) exposing the layers while in contact with each other to ionising radiation which causes cross-linking of polymers at the interface.

BRIEF DESCRIPTION OF THE DRAWING

The FIGURE in the accompanying drawings is a diagrammatic cross-section, not to scale, of an insulated wire according to the invention, showing a metallic conductor 1, an inner insulating layer 2, and an outer insulating layer 3.

DETAILED DESCRIPTION OF THE INVENTION

When the first polymeric component does not consist solely of the carbonyl-containing polymer, any other polymer present in the first polymeric component is preferably a polyolefin, particularly high-density polyethylene.

The fluoropolymer in the second polymeric composition is preferably selected from copolymers of tetrafluoroethylene and ethylene and optionally a third comonomer, copolymers of tetrafluoroethylene and vinylidene fluoride and optionally a third comonomer, copolymers of chlorotrifluoroethylene and ethylene and optionally a third comonomer, copolymers of hexafluoropropylene and ethylene and optionally third comonomer, and copolymers of hexafluoropropylene and vinylidene fluoride and optionally a third comonomer.

Each of the layers (I) and (II) optionally contains polyolefin-based layer (I), in addition to the polymeric component of the composition, a non-polymeric component comprising additives such as anti-oxidants, pigments, fillers, flame retardants, etc. to enhance mechanical, thermal, electrical etc. properties of the polymeric composition.

In the method of the invention, step (A) can make use of any process which causes intimate contact between the layers (I) and (II). Examples include coating one of the polymeric compositions onto a pre-formed layer of the other, and dual or multi-walled extrusion to form insulation layers respectively containing one or other of the polymeric compositions. Preferably, the layer (I) composed of the first composition (which comprises the carbonyl-containing polymer) is an inner layer and the fluoropolymer-based layer (II) is an outer layer on the wire. The layers made from the two different compositions can be coextruded, tandem extruded, multipass extruded, or coated by other means. Known wire insulation processes such as tube draw-down extrusion may be used, to form one or more of the layers, but pressure extrusion as known per se is preferred for optimum adhesion of the second and any subsequent insulation layers to be applied to a pre-formed underlying layer.

In step (B) of the method of the invention, the insulation on the wire is exposed to conditions which cause a cross-linking reaction. The cross-linking which may involve chemical reagents such as peroxides, but preferably is effected by radiation, especially radiation from a source of ionising radiation capable of causing the formation of free radicals and thus, cross-links, in the polymers, some of which should preferably be formed in the region of the interface between the two compositions. Penetration of the radiation into the insulation at least as far as the interface is therefore desirable, although not necessarily essential if ion or radical mobility, for example, enables molecular reactions to continue at or near the interface after the radiation process. The radiation source could, for example, be a radio-isotope, or an X-ray source, or possibly a non-ionising radical-generating source, for example a UV source, but is preferably an electron beam, more preferably one providing a beam dose greater than 2 Mrads, preferably at least 5 Mrads, more preferably at least 10 Mrads, very preferably at least 15 Mrads, into the material.

It has been found that, when the cross-linking is effected by ionizing radiation, enhancements to the interfacial bond strength may be obtained by including a cross-linking promoter ("pro-rad") in the first and/or second polymeric composition. Known pro-rads may be used, preferably methacrylate/acrylate based pro-rads, e.g. trimethylolpropanetrimethacrylate (TMPTM), or pro-rads of the multifunctional allyl type, preferably triallyl cyanurate (TAC), more preferably triallyl isocyanurate (TAIC).

Experimental Results

All results quoted in the tables below were obtained by testing pressed plaques of the two materials prepared by the usual polymer handling techniques, well known per se. The plaques were pressed together to adhere them temporarily face-to-face and the adhering plaques were then irradiated as indicated. Plaques were used to represent the layers I and II for these demonstration experiments, due to the relative ease of measuring bond strength on plaques, rather than on wires. Conditions for these experiments were as follows:

Plaque dimensions: 150 mm by 150 mm by 0.85 mm
Pressing temperature: 220° C.

Pressing time: 2 minute preheat, 1 minute at pressure

Pressing pressure: 20–40 Tons between 300 mm by 300 mm metal plates

Cooling conditions: 2 minutes at same pressure with same plates water cooled.

In the Experimental Results shown below, the first composition (comprising the carbonyl-containing polymer) is referred to as the polyolefin-based material and as Material 1, and the second composition is referred to as the fluoropolymer-based material and as Material 2; and the following abbreviations are used (in addition to those already given). EEA is ethylene/ethyl acrylate copolymer. EMA is ethylene/methyl acrylate copolymer. HDPE is high-density polyethylene. PVDF is polyvinylidene fluoride. ETFE is ethylene/tetrafluoroethylene copolymer. ECTFE is ethylene/chlorotrifluoroethylene copolymer. MFR is melt flow rate.

| Material 1 | Material 2 | Dose (Mrads) | Mean maximum peel force (N) |
|---|---|---|---|
| Example of Effect of Radiation Dose on Bond strength developed between appropriate polyolefin and fluoropolymer-based materials | | | |
| EEA copolymer of 15 wt % EA content | ETFE of MFR* = 33 | 0 | 0.5 |
| EEA copolymer of 15 wt % EA content | ETFE of MFR* = 33 | 20 | 9 |
| EMA copolymer of 28 wt % MA content | ETFE of MFR* = 33 | 0 | 0.8 |
| EMA copolymer of 28 wt % MA content | ETFE of MFR* = 33 | 20 | 5 |
| EEA copolymer of 15 wt % EA content | ETFE of MFR* = 5.5 + 5 wt % TAC | 0 | 0.5 |
| EEA copolymer of 15 wt % EA content | ETFE of MFR* = 5.5 + 5 wt % TAC | 20 | 17.5 |
| EEA copolymer of 15 wt % EA content | ECTFE of MFR** = 11 | 0 | 1.5 |
| EEA copolymer of 15 wt % EA content | ECTFE of MFR** = 11 | 20 | 28 |
| EEA copolymer of 15 wt % EA content | Terpolymer of tetrafluoroethylene, hexafluoropropylene & vinylidene fluoride of MFR** = 13 | 0 | 1.8 |
| EEA copolymer of 15 wt % EA content | Terpolymer of tetrafluoroethylene, hexafluoropropylene & vinylidene fluoride of MFR** = 13 | 20 | 36 |
| EEA copolymer of | Terpolymer of hexa- | 0 | 2.4 |

-continued

| Material 1 | Material 2 | Dose (Mrads) | Mean maximum peel force (N) |
|---|---|---|---|
| 15 wt % EA content | fluoropropylene, tetrafluoroethylene & ethylene of MFR** = 6.7 | | |
| EEA copolymer of 15 wt % EA content | Terpolymer of hexafluoropropylene, tetrafluoroethylene & ethylene of MFR** = 6.7 | 20 | 13 |
| Example of Effect of the addition of Pro-rad in fluoropolymer-based material on bond strength with appropriate polyolefin-based material after electron beam crosslinking | | | |
| EEA copolymer of 15 wt % EA content | ETFE of MFR* = 5.5 | 20 | 6.5 |
| EEA copolymer of 15 wt % EA content | ETFE of MFR* = 5.5 + 5 wt % TAC | 20 | 17.5 |
| Effect of percentage Copolymer in a polyolefin polymer blend on bond strength with appropriate non-PVDF-based fluoropolymer-based material after electron beam crosslinking | | | |
| 100% HDPE | ETFE of MFR* = 33 | 20 | 0 |
| 100% EEA copolymer of 15 wt % EA content | ETFE of MFR* = 33 | 20 | 9 |

The Melt Flow Rate (MFR) used to describe the fluoropolymers in the tables above is quoted in units of grammes/10 minutes and was measured according to ASTM D1238-95 under the following conditions;
*297° C./5 Kg
**265° C./5 Kg.

Examples of Wire Construction

An electrical wire in which the insulation consists of two polymeric layers bonded together according to the present invention was made as follows:

The inner layer of insulation (I) (i.e. nearer to the wire conductor) was a polyolefin-based material, consisting predominantly of (a) an EEA copolymer containing 15 wt % EA and (b) HDPE in a weight ratio of approximately 8:2 copolymer:HDPE, with usual other additives present in smaller proportions including crosslinking promoters, stabilisers, antioxidants, pigments and process aids at a total level of 24 wt %. This layer was pressure extruded onto the metallic conductor.

The outer layer of insulation (II) consisted predominantly of an ETFE copolymer, which in this example contains a crosslinking promoter at 8 wt %. This outer layer was pressure extruded in a separate operation onto the preformed inner layer. This coated wire product was then passed through an electron beam, and received a radiation dose of 20 Mrads.

In a second example a wire was made as above, in which the additives of the inner layer were added at a total level of 22.9 wt % and the outer layer was comprised solely of the ETFE copolymer. This coated wire product was then passed through an electron beam, and received a radiation dose of 20 Mrads.

Demonstration of Improved Performance of Wire as in the Example above, Relative to a Wire of Similar Construction in which the Inner and Outer Insulation Layers are not Bonded.

A wire of the above construction and manufacturing process (designated wire A) was compared with another crosslinked but non-bonded polyolefin/ETFE dual-walled wire (designated wire B) of the same dimensions, over a range of tests for wire robustness relevant to harsh handling and end use environments. The following results were obtained.

Example of Resistance to Insulation Separation Improvement

Method: wire size 0.75 $mm^2$, wire insulation slit to depth of conductor along wire axis, slit length 50 mm, 4 close-pitched wraps around a 3.60 mm mandrel then unwrapped until straight, temperature 23° C.

| Wire Type | Result of insulation separation test |
|---|---|
| A | No spontaneous separation/delamination of core and PJ observed |
| B | PJ spontaneously wrinkled and separated from core |

Example of Scrape Abrasion Resistance Improvement

Method: Equipment=conventional type wire scrape abrader, wire size 0.75 $mm^2$(conductor cross sectional area), blade type angled 90°, with 0.225 mm radiused edge contact point, applied load 0.5 Kg, stroke length 10 mm, at 55 cycles/minute, temperature 23° C.

| Wire Type | No. of scrape cycles to abrade through PJ |
|---|---|
| A | 540 |
| B | 129 |

What is claimed is:

1. An electrical wire or cable having insulation comprising (I) a first layer which is composed of a first polymeric composition consisting of a first polymeric component and optionally a first non-polymeric component, the first polymeric component comprising at least 20% by weight, based on the weight of the first polymeric component, of a carbonyl-containing polymer comprising at least 5% by weight, based on the weight of the carbonyl-containing polymer, of repeating units derived from a monomer which can be copolymerized with an olefinic monomer and which contains a carboxylic acid ester group; and (II) a second layer which is in direct contact with the first layer at an interface, and which is composed of a second polymeric composition consisting of a second polymeric component and optionally a second non-polymeric component, the second polymeric component comprising at least 10% by weight, based on the weight of second polymeric composition, of a fluoropolymer, and being free of polymers containing more than 50% by weight, based on the weight of the polymer, of repeating units derived from vinylidene fluoride.

2. A wire or cable according to claim 1 wherein the first and second layers have been subjected, while in direct contact with each other, to conditions which cause crosslinking of polymers at the interface between them.

3. A wire or cable according to claim 2 wherein the crosslinking of polymers at the interface is such that at least one of the following conditions is fulfilled:

(i) the peel bond strength between the layers, measured by ASTM 81876-95, is at least 3N, (ii) when a sample of the electrical wire or cable is subjected to steps (a), (b) and (c), there is no delamination of the two layers, step (a) being to slit the insulation axially over a length of 50 mm down to the conductor, step (b) being to wrap the wire around a mandrel whose diameter is twice the diameter of the insulated wire, with the slit on the outside of the wrapped wire, thus exposing the conductor, and step (c) being to unwrap the wire from the mandrel until the wire is straight, and (iii) the peel bond strength after the crosslinking, measured by ASTM B1876-95, is at least 100% greater than the peel bond strength before the crosslinking, measured by ASTM B1876-95.

4. A wire or cable according to claim 1 wherein the first polymeric component consists essentially of the carbonyl-containing polymer and a polyolefin.

5. A wire or cable according to claim 1 wherein the first polymeric component contains at least 60% by weight, based on the weight of the first polymeric component, of the carbonyl-containing polymer, and the second polymeric composition contains at least 50% by weight, based on the weight of the second composition, of the fluoropolymer.

6. A wire or cable according to claim 1 wherein the first polymeric component contains 80 to 100% by weight, based on the weight of the first polymeric component, of the carbonyl-containing polymer.

7. A wire or cable according to claim 1 wherein the carbonyl-containing polymer contains 15 to 28% by weight, based on the weight of the carbonyl-containing polymer, of the repeating units containing a carboxylic acid ester group.

8. A wire or cable according to claim 1 wherein the second polymeric component comprises at least 90% by weight, based on the weight of the second polymeric composition, of the fluoropolymer.

9. A wire or cable according to claim 1 wherein each fluoropolymer in the second polymeric component is selected from copolymers of tetrafluoroethylene and ethylene and optionally a third comonomer, copolymers of tetrafluoroethylene and vinylidene fluoride and optionally a third comonomer, copolymers of chlorotrifluoroethylene and ethylene and optionally a third comonomer, copolymers of hexafluoropropylene and ethylene and optionally third comonomer, and copolymers of hexafluoropropylene and vinylidene fluoride and optionally a third comonomer.

10. A wire or cable according to claim 1 wherein the first layer is an inner layer and the second layer is an outer layer.

11. An insulated electrical wire comprising (1) a metallic conductor, and (2) insulation which comprises (I) an inner layer which is composed of a first polymeric composition consisting of a first polymeric component and optionally a first non-polymeric component, the first polymeric component consisting essentially of 60 to 100% by weight, based on the weight of the first polymeric component, of a carbonyl-containing polymer, and 0 to 40% by weight, based on the weight of the first polymeric component, of a polyolefin, the carbonyl-containing polymer consisting essentially of (a) 9 to 100% by weight, based on the weight of the carbonyl-containing polymer, of repeating units derived from a monomer which can be copolymerized with an olefin and which contains a carboxylic acid ester group, and (b) 91 to 0% by weight, based on the weight of the carbonyl-containing polymer, of repeating units derived from an olefin; and (II) an outer layer which surrounds and directly contacts the first layer at an interface, and which is composed of a second polymeric composition consisting of a second polymeric component and optionally a second non-polymeric component, the second polymeric component comprising at least 50% by weight, based on the weight of second polymeric composition, of one or more fluoropolymers, and being free of polymers containing more than 50% by weight, based on the weight of the polymer, of repeating units derived from vinylidene fluoride.

12. An insulated wire according to claim 11 wherein the inner and outer layers have been subjected, while in direct contact with each other to ionizing radiation which causes crosslinking of polymers at the interface, and at least one of the layers contains a crosslinking promoter before it is irradiated.

13. An insulated wire according to claim 12 wherein the crosslinking of polymers at the interface is such that at least one of the following conditions is fulfilled (i) the peel bond strength between the layers, measured by ASTM 81876-95, is at least 3N, (ii) when a sample of the electrical wire or cable is subjected to steps (a), (b) and (c), there is no delamination of the two layers, step (a) being to slit the insulation axially over a length of 50 mm down to the conductor, step (b) being to wrap the wire around a mandrel whose diameter is twice the diameter of the insulated wire, with the slit on the outside of the wrapped wire, thus exposing the conductor, and step (c) being to unwrap the wire from the mandrel until the wire is straight, and (iii) the peel bond strength after the crosslinking, measured by ASTM B1876-95, is at least 100% greater than the peel bond strength before the crosslinking, measured by ASTM B1876-95.

14. An insulated wire according to claim 12 wherein the first polymeric component contains 80 to 100% by weight, based on the weight of the first polymeric component, of the carbonyl-containing polymer, and the carbonyl-containing polymer contains 15 to 28% by weight, based on the weight of the carbonyl-containing polymer, of the repeating units containing a carboxylic acid ester group.

15. An insulated wire according to claim 12 wherein the repeating units containing a carboxylic acid ester group are derived from vinyl acetate or an alkyl acrylate, and the first composition comprises a mixture of the carbonyl-containing polymer and high-density polyethylene.

16. An insulated wire according to claim 12 wherein the second polymeric component comprises at least 90% by weight, based on the weight of the second polymeric composition, of one or more fluoropolymers.

17. An insulated wire according to claim 12 wherein each fluoropolymer in the second polymeric component is selected from the group consisting of copolymers of tetrafluoroethylene and ethylene and optionally a third comonomer, copolymers of tetrafluoroethylene and vinylidene fluoride and optionally a third comonomer, copolymers of chlorotrifluoroethylene and ethylene and optionally a third comonomer, copolymers of hexafluoropropylene and ethylene and optionally third comonomer, and copolymers of hexafluoropropylene and vinylidene fluoride and optionally a third comonomer.

18. An insulated wire according to claim 12 wherein the inner layer directly contacts the metallic conductor.

19. A method of making an insulated wire or cable, the method comprising the steps of (A) providing an electrical conductor surrounded by (I) a first layer which is composed of a first polymeric composition consisting of a first polymeric component and optionally a first non-polymeric component, the first polymeric component comprising at least 20% by weight, based on the weight of the first polymeric component, of a carbonyl-containing polymer containing at least 5% by weight, based on the weight of the carbonyl-containing polymer, of repeating units derived from a monomer which can be copolymerized with an olefinic comonomer and which contains a carboxylic acid ester group; and (II) a second layer which is composed of a second polymeric composition consisting of a second polymeric component and optionally a second non-polymeric component, the second polymeric component comprising at least 10% by weight, based on the weight of second polymeric composition, of a fluoropolymer, and being free of polymers containing more than 50% by weight, based on the weight of the polymer, of repeating units derived from vinylidene fluoride;

the first and second layers being in direct contact with each other at an interface; and (B) exposing the layers while in contact with each other to ionizing radiation which causes cross-linking of polymers at the interface.

20. A method according to claim 19 wherein step (A) comprises bringing the respective layers into contact with each other at a temperature above the melting or softening point of the polymeric component in at least one of the layers.

21. A method according to claim 19 wherein at least one of the first and second polymeric compositions contains a radiation cross-linking promoter.

* * * * *